US008376492B2

(12) United States Patent
Ozawa

(10) Patent No.: US 8,376,492 B2
(45) **Date of Patent: *Feb. 19, 2013**

(54) LIQUID EJECTING APPARATUS AND CONTROLLING METHOD OF THE SAME

(75) Inventor: Kinya Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 237 days.

This patent is subject to a terminal disclaimer.

(21) Appl. No.: 12/649,220

(22) Filed: Dec. 29, 2009

(65) Prior Publication Data

US 2010/0171778 A1 Jul. 8, 2010

(30) Foreign Application Priority Data

Jan. 8, 2009 (JP) ..... 2009-002641

(51) Int. Cl.
*B41J 29/38* (2006.01)

(52) U.S. Cl. ..... 347/10

(58) Field of Classification Search ..... 347/5, 9–11, 347/68

See application file for complete search history.

(56) References Cited

U.S. PATENT DOCUMENTS

| | | | | |
|---|---|---|---|---|
| 6,095,630 | A | 8/2000 | Horii et al. | |
| 6,328,398 | B1 | 12/2001 | Chang | |
| 6,431,675 | B1 * | 8/2002 | Chang | 347/10 |
| 6,467,865 | B1 | 10/2002 | Iwamura et al. | |
| 6,764,152 | B2 | 7/2004 | Umeda et al. | |
| RE38,941 | E | 1/2006 | Ishikawa | |
| 7,073,878 | B2 | 7/2006 | Nishida et al. | |
| 7,513,586 | B2 | 4/2009 | Mataki | |
| 7,934,786 | B2 * | 5/2011 | Ozawa | 347/11 |
| 8,016,377 | B2 | 9/2011 | Uraki | |
| 2004/0017413 | A1 | 1/2004 | Kusunoki | |
| 2004/0212646 | A1 | 10/2004 | Nishida et al. | |
| 2006/0125856 | A1 | 6/2006 | Kitami et al. | |
| 2008/0106558 | A1 | 5/2008 | Azami | |

FOREIGN PATENT DOCUMENTS

| | | | |
|---|---|---|---|
| EP | 0947325 | A1 | 10/1999 |
| JP | 02-184449 | A | 7/1990 |
| JP | 2000-141642 | B2 | 5/2000 |
| JP | 2003-094656 | A | 4/2003 |
| JP | 2006-306076 | A | 11/2006 |
| JP | 2008-023865 | A | 2/2008 |

* cited by examiner

*Primary Examiner* — An Do

(74) *Attorney, Agent, or Firm* — Kilpatrick Townsend & Stockton LLP

(57) ABSTRACT

A liquid ejecting apparatus includes: a liquid ejecting head which includes a pressure generating chamber communicating with a nozzle opening and a pressure generating element causing variation in a pressure of a liquid in the pressure generating chamber and which ejects the liquid from the nozzle opening by an operation of the pressure generating element; and a driving signal generating unit which generates a series of driving signals containing a driving pulse used to drive the pressure generating element. The driving pulse generated by the driving signal generating unit contains a plurality of expansion components expanding the pressure generating chamber and drawing a meniscus and an ejection component varying a voltage so as to contract the expanded pressure generating chamber and ejecting a liquid droplet. The expansion component includes a first expansion component and a second expansion component drawing the meniscus at a voltage variation ratio different from that of the first expansion component.

6 Claims, 5 Drawing Sheets

LIQUID EJECTING APPARATUS AND CONTROLLING METHOD OF THE SAME

This application claims priority to Japanese Patent Application No. 2009-002641, filed Jan. 8, 2009 the entirety of which is incorporated by reference herein.

BACKGROUND

1. Technical Field

The present invention relates to a liquid ejecting apparatus such as an ink jet printer and a method of controlling the liquid ejecting apparatus, and in particular, to a liquid ejecting apparatus including a liquid ejecting head capable of ejecting a liquid in pressure generating chambers from nozzle openings by varying pressure in the pressure generating chambers communicating with the nozzle openings and a method of controlling the liquid ejecting apparatus.

2. Related Art

A liquid ejecting apparatus is an apparatus which includes a liquid ejecting head capable of ejecting a liquid and ejects a variety of liquids from the liquid ejecting head. The representative example of the liquid ejecting apparatus is an image forming apparatus, such as an ink jet printer (hereinafter, simply referred to as a printer) which includes an ink jet printing head (hereinafter, simply referred to as a printing head) serving as a liquid ejecting head and prints an image or the like by ejecting and landing liquid-like ink onto a print medium (landing target) such as a print sheet from nozzles of the printing head. In recent years, the liquid ejecting apparatus has been applied to a variety of manufacturing apparatuses such as an apparatus manufacturing a color filter such as a liquid crystal display, as well as the image printing apparatus.

A liquid ejecting apparatus is configured so as to eject a liquid from nozzles communicating with pressure generating chambers by applying an ejection driving pulse to pressure generating elements (for example, piezoelectric vibrators or heating elements), driving the pressure generating elements, varying the pressure of the liquid in the pressure generating chambers, and using this variation in the pressure. In the liquid ejecting apparatus, the amount of liquid ejected can be increased by enlarging the amplitude of pressure vibration to be applied to the liquid in the pressure generating chambers. In other words, the amount of liquid ejected can be increased by enlarging the driving voltage of the ejection driving pulse (for example, see JP-A-2003-94656).

In recent years, the liquid ejecting apparatus has tried to eject a liquid (hereinafter, also referred to as a high-viscosity liquid) having a viscosity higher than that of a known liquid such as UV ink (ultraviolet curing ink). That is, in the past, a liquid, such as water, having a low viscosity was mainly used. In recent years, however, a high-viscosity liquid with 6 mPa·s or more has been tried to be ejected. In order to eject a sufficient amount of high-viscosity liquid, it is necessary to vary the magnitude of pressure so as to correspond to the amount of high-viscosity ejected and apply the pressure to the pressure generating chambers. However, when the variation in the pressure is increased, a flying speed of the liquid becomes larger. Therefore, the rear portion of the liquid may easily grow to become a tail-like shape. Moreover, a problem may arise in that the tail-like portion separated and flying from the main portion of a liquid droplet is not landed on the regular location (desired location) of a landing target. In the ink jet printer, for example, the tail-like portion may become mist and be landed out of the regular location, so that a dot is separated. Therefore, a problem may arise in that an image quality deteriorates. In particular, in the high-viscosity liquid, since the tail-like portion is separated into several pieces, the several separated pieces (satellite ink droplets or mist) may result in deteriorating the image quality to a great extent.

SUMMARY

An advantage of some aspects of the invention is that it provides a liquid ejecting apparatus capable of preventing separation of a dot by inhibiting mist or the like from occurring when ejecting a high-viscosity liquid, and a method of controlling the liquid ejecting apparatus.

According to an aspect of the invention, there is provided a liquid ejecting apparatus including: a liquid ejecting head which includes a pressure generating chamber communicating with a nozzle opening and a pressure generating element causing variation in a pressure of a liquid in the pressure generating chamber; and a driving signal generating unit which generates a series of driving signals containing a driving pulse used to drive the pressure generating element. The driving pulse generated by the driving signal generating unit contains a plurality of expansion components expanding the pressure generating chamber and drawing a meniscus and an ejection component varying a voltage so as to contract the expanded pressure generating chamber and ejecting a liquid droplet. The expansion component includes a first expansion component and a second expansion component drawing the meniscus at a voltage variation ratio different from that of the first expansion component.

With such a configuration, the liquid ejecting apparatus includes: the liquid ejecting head which includes the pressure generating chamber communicating with the nozzle opening and the pressure generating element causing variation in the pressure of the liquid in the pressure generating chamber and which ejects the liquid from the nozzle opening by the operation of the pressure generating element; and the driving signal generating unit which generates a series of driving signals containing the driving pulse used to drive the pressure generating element. The driving pulse generated by the driving signal generating unit contains the plurality of expansion components expanding the pressure generating chamber and drawing the meniscus and the ejection component varying a voltage so as to contract the expanded pressure generating chamber and ejecting the liquid droplet. The expansion component includes the first expansion component and the second expansion component drawing the meniscus at the voltage variation ratio different from that of the first expansion component. When the liquid (high viscosity liquid) having a relatively high viscosity is drawn toward the pressure generating chamber, the peripheral edge (which is close to the inner circumference of the nozzle opening) of the meniscus in the nozzle opening moves less than the central portion of the meniscus. Moreover, even when it is difficult to follow the variation in the pressure, the liquid in the central portion of the meniscus and the liquid in the outer peripheral edge of the meniscus are ejected at matched timing just as the liquids are almost attached. Accordingly, when the liquid droplets are ejected by the contraction of the pressure generating chamber later, it is possible to prevent the central portion of the meniscus and the outer peripheral edge of the meniscus in the nozzle opening from becoming the opposite phase. Therefore, since the rear end of the ejected liquid is prevented from growing into the tail-like portion, the ejected liquid can be ejected in a shape almost close to a spherical shape. As a consequence, the liquid is prevented from being separated into plural pieces and landed on a landing target such as a print sheet. Moreover, it is possible to reduce deterioration in the landing speed of the liquid droplets caused due to the opposite phase.

In the liquid ejecting apparatus having the configuration, the voltage variation ratio of the first expansion component may be set so as to be smaller than the voltage variation ratio of the second expansion ratio.

With such a configuration, since the voltage variation ratio of the first expansion component is set so as to be smaller than the voltage variation ratio of the second expansion ratio, the outer peripheral edge of the meniscus in the nozzle opening is prevented from moving later than the central portion of meniscus in the nozzle opening during holding the voltage of the first expansion component. Accordingly, when the liquid droplets are ejected by the contraction of the pressure generating chamber, it is possible to prevent the central portion of the meniscus and the outer peripheral edge of the meniscus in the nozzle opening from becoming the opposite phase. Therefore, the ejected liquid is prevented from growing into the tail-like portion.

In the liquid ejecting apparatus having the configuration, an expansion hold component, which holds the voltage in the rear end of the first expansion component for a certain period of time, may be provided between the first and second expansion components.

With such a configuration, since the expansion component includes the expansion hold component, which holds the voltage in the rear end of the first expansion component for a certain period of time, between the first and second expansion components, the outer peripheral edge of the meniscus in the nozzle opening is prevented from moving later than the central portion of meniscus in the nozzle opening during holding the voltage. Accordingly, when the liquid droplets are ejected by the contraction of the pressure generating chamber, it is possible to prevent the central portion of the meniscus and the outer peripheral edge of the meniscus in the nozzle opening from becoming the opposite phase. Therefore, the ejected liquid is prevented from growing into the tail-like portion.

In the liquid ejecting apparatus having the configuration, the ejection component may include a first ejection component and a second ejection component contracting the pressure generating chamber at a voltage variation ratio different from that of the first ejection component.

With such a configuration, since the ejection component includes the first ejection component and the second ejection component contracting the pressure generating chamber at the voltage variation ratio different from that of the first ejection component, it is possible to prevent the central portion of the meniscus and the outer peripheral edge of the meniscus in the nozzle opening from becoming the opposite phase. In this state, when the liquid droplets are ejected by the contraction of the pressure generating chamber, the liquid in the central portion of the meniscus and the liquid in the outer peripheral edge of the meniscus can be ejected at matched timing, just as the liquids snuggle. As a consequence, since the ejected liquid is prevented from growing into the tail-like portion, the liquid is prevented from being separated into plural pieces and landed on the landing target.

In the liquid ejecting apparatus having the configuration, an ejection hold component, which holds the voltage in the rear end of the first ejection component for a certain period of time, may be provided between the first and second ejection components.

With such a configuration, since the ejection component includes the ejection hold component, which holds the voltage in the rear end of the first ejection component for a certain period of time, between the first and second ejection components, it is possible to prevent the central portion of the meniscus and the outer peripheral edge of the meniscus in the nozzle opening from becoming the opposite phase. In this state, when the liquid droplets are ejected by the contraction of the pressure generating chamber, the liquid in the central portion of the meniscus and the liquid in the outer peripheral edge of the meniscus can be ejected at matched timing, just as the liquids are almost attached. As a consequence, since the ejected liquid is prevented from growing into the tail-like portion, the liquid is prevented from being separated into plural pieces and landed on the landing target.

According to another aspect of the invention, there is provided a method of controlling a liquid ejecting apparatus including a liquid ejecting head which includes a pressure generating chamber communicating with a nozzle opening and a pressure generating element causing variation in a pressure of a liquid in the pressure generating chamber and which ejects the liquid from the nozzle opening by an operation of the pressure generating element, and a driving signal generating unit which generates a series of driving signals containing a driving pulse used to drive the pressure generating element. The method includes: a plurality of expansion steps of expanding the pressure generating chamber and drawing a meniscus; and an ejection step of varying a voltage so as to contract the pressure generating chamber expanded pressure generating chamber in the expansion steps and ejecting a liquid droplet. The expansion steps include a first expansion step and a second expansion step of drawing the meniscus at a voltage variation ratio different from that of the first expansion step.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment of the invention will be described with reference to the accompanying drawings. The embodiment described below as an exemplary embodiment of the invention limits the invention in various forms, but the scope of the invention is not limited in the various forms by the following description, as long as the details limiting the invention is not particularly described. In addition, an ink jet printing apparatus (hereinafter, referred to as a printer) apparatus according to the invention will be described below as an example of a liquid ejecting apparatus.

Figure 1:
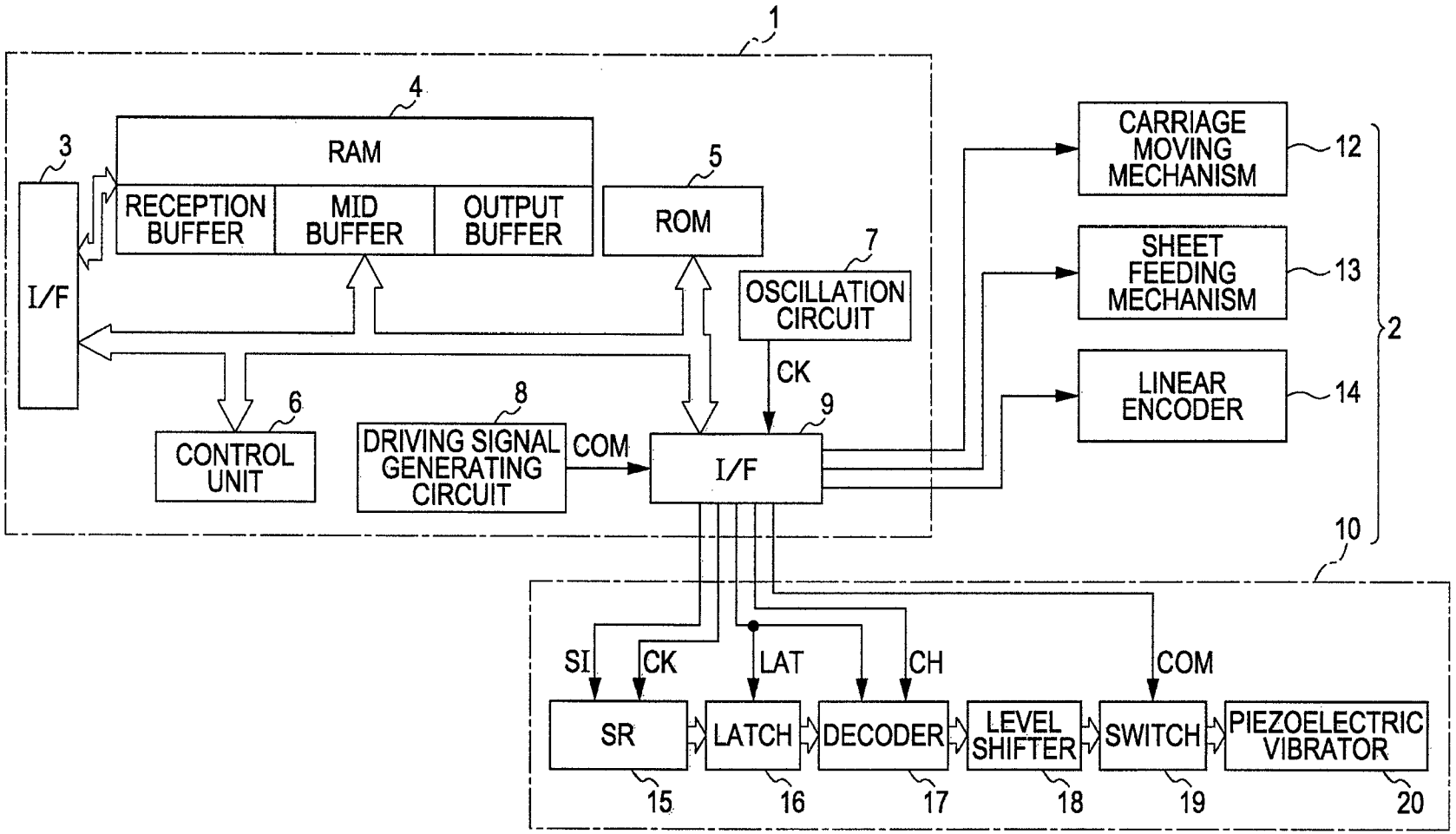
FIG. 1 is a block diagram illustrating the electrical configuration of a printer.

FIG. 1 is a block diagram illustrating the electrical configuration of the printer. The printer includes a printer controller 1 and a print engine 2 as a whole. The printer controller 1 includes an external interface (external I/F) 3 which transmits and receives data to and from an external apparatus such as a host computer, a RAM 4 which stores a variety of data, a ROM 5 which stores a control routine or the like used to process the variety of data, a control unit 6 which controls each unit, an oscillation circuit 7 which generates a clock signal, a driving signal generating circuit 8 which generates a driving signal to be supplied to a printing head 10, and an internal interface (internal I/F) 9 which outputs dot pattern data, the driving signal, or the like to the printing head 10.

The control unit 6 controls each unit and also converts print data received from the external apparatus through the external I/F 3 into dot pattern data to output the dot pattern data to the printing head 10 through the internal I/F 9. The dot pattern data is constituted by print data obtainable by decoding (translating) gray scale data. The control unit 6 supplies a latch signal, a channel signal, or the like to the printing head 10 on the basis of the clock signal from the oscillation circuit 7. A latch pulse or a channel pulse contained in the latch signal or the channel signal defines supply time of each pulse constituting the driving signal.

The driving signal generating circuit 8 generates a driving signal used to drive a piezoelectric vibrator 20 (see FIG. 2) under the control of the control unit 6. The driving signal generating circuit 8 according to this embodiment is configured to generate a driving signal COM which includes: an ejection pulse used to eject an ink droplet (which is a kind of liquid droplet) and form a dot on a print sheet, which is a kind of ejection target; and a minute vibration pulse used to minutely vibrate a free surface of ink (which is a kind of liquid), that is, a meniscus exposed to a nozzle opening 32 (see FIG. 2) and agitate ink within one print period.

Next, the configuration of the print engine 2 will be described. The print engine 2 includes the printing head 10, a carriage moving mechanism 12, a sheet feeding mechanism 13, and a linear encoder 14. The printing head 10 includes a shift register (SR) 15, a latch 16, a decoder 17, a level shifter 18, a switch 19, and piezoelectric vibrators 20. The dot pattern data (SI) from the printer controller 1 is transmitted serially to the shift register 15 in synchronization with the clock signal (CK) from the oscillation circuit 7. The dot pattern data is 2-bit data and constituted by gray scale information indicating print gray scale (ejection gray scale) of four gray scales, such as non-print (minute vibration), a small dot, a middle dot, and a large dot. Specifically, the non-print is expressed by gray scale information "00", the small dot is expressed by gray scale information "01", the middle dot is expressed by gray scale information "10", and the large dot is expressed by gray scale information "11".

The latch 16 is electrically connected to the shift register 15. Therefore, when a latch signal (LAT) is input from the printer controller 1 to the latch 16, the dot pattern data of the shift register 15 is latched. The dot pattern data latched by the latch 16 is input to the decoder 17. The decoder 17 translates the 2-bit dot pattern data and generates pulse selection data. The pulse selection data is formed by making each bit correspond to each pulse forming the driving signal COM. In addition, the ejection pulse is supplied or not supplied to the piezoelectric vibrators 20 depending on the contents of each bit, for example, "0" or "1".

The decoder 17 outputs the pulse selection data to the level shifter 18 when receiving the latch signal (LAT) or the channel signal (CH). In this case, the pulse selection data is input to the level shifter 18 in order from a higher-order bit. The level shifter 18 serves as a voltage amplifier. When the bit of the pulse selection data is "1", a voltage driving the switch 19, for example, an electric signal boosted by about several tens of voltage is output. The pulse selection data with the bit of "1" which is boosted by the level shifter 18 is supplied to the switch 19. The driving signal COM from the driving signal generating circuit 8 is supplied to an input portion of the switch 19 and the piezoelectric vibrators 20 are connected to the output portion of the switch 19.

The pulse selection data is used to control the operation of the switch 19, that is, the supply of the driving pulse of the driving signal to the piezoelectric vibrators 20. For example, while the bit of the pulse selection data input to the switch 19 is "1", the switch 19 becomes a connection state. At this time, the corresponding ejection pulse is supplied to the piezoelectric vibrators 20, and the potential level of the piezoelectric vibrators 20 is varied in accordance with the waveform of the ejection pulse. On the other hand, while the bit of the pulse selection data input to the switch 19 is "0", no electric signal used to operate the switch 19 is output from the level shifter 18. Therefore, the switch 19 becomes a disconnection state, and thus no ejection pulse is supplied to the piezoelectric vibrators 20.

The decoder 17, the level shifter 18, the switch 19, the control unit 6, and the driving signal generating circuit 8 executing these operations serve as a driving unit according to the invention, and select the necessary ejection pulse from the driving signal to apply (supply) the selected ejection pulse to the piezoelectric vibrators 20. As a consequence, the piezoelectric vibrators 20 are expanded or contracted. A pressure generating chamber 35 (see FIG. 2) is expanded or contracted in response to the expansion and the contraction of the piezoelectric vibrators 20, and thus ink droplets of an amount corresponding to the gray scale information constituting the dot pattern data are ejected from the nozzle opening 32.

Figure 2:
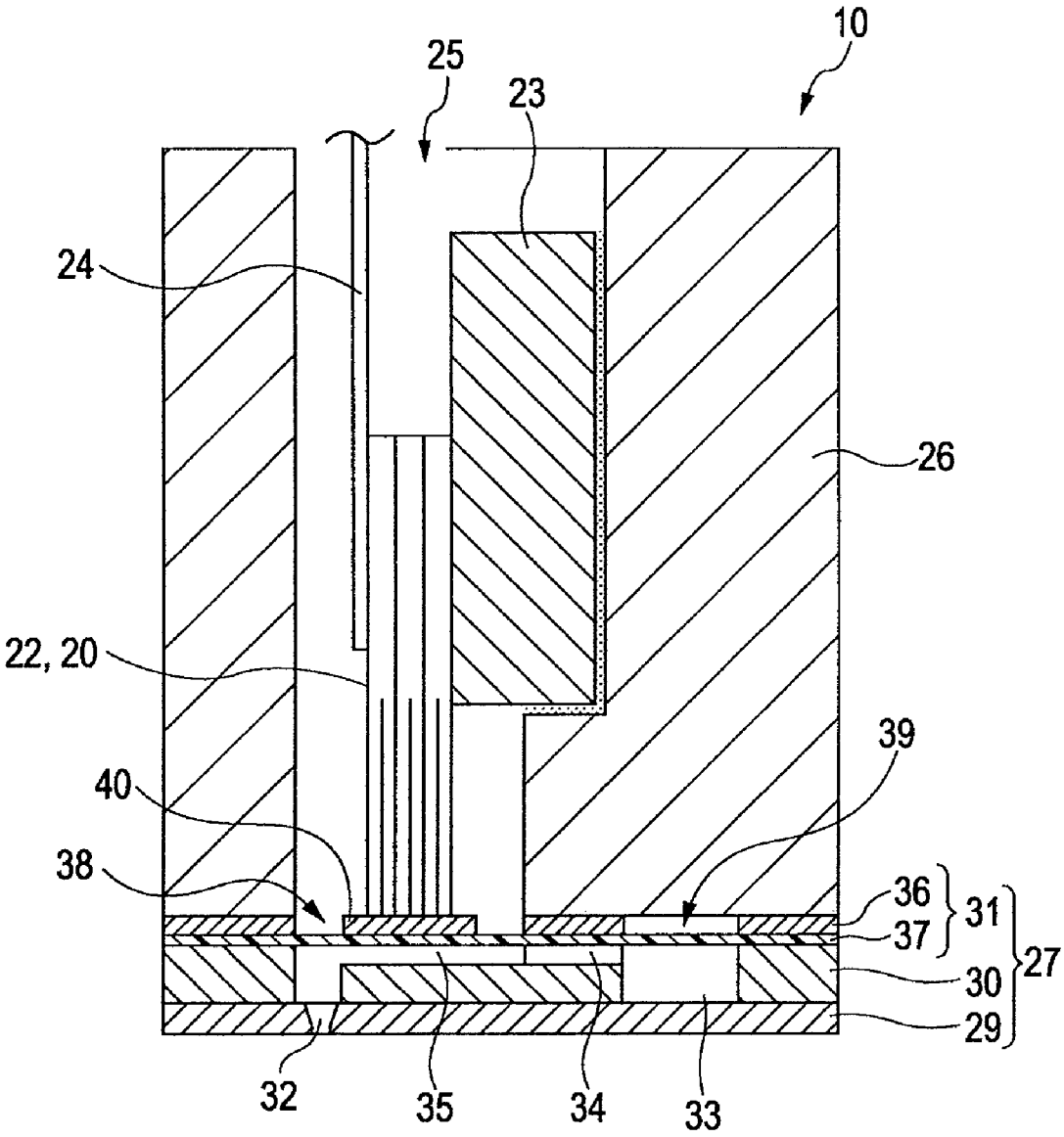
FIG. 2 is a sectional view illustrating the configuration of main elements of a printing head.

FIG. 2 is a sectional view illustrating the configuration of main elements of the printing head 10. The printing head 10 according to this embodiment includes a vibrator unit 25 constituted by a piezoelectric vibrator group 22, a fixing plate 23, a flexible cable 24, and the like, a head case 26 capable of accommodating the vibrator unit 25, and a passage unit 27 forming a series of ink passages (liquid passages) from a common ink chamber (common liquid chamber) to the nozzle opening 32 communicating with the pressure generating chamber 35.

First, the vibrator unit 25 will be described. The piezoelectric vibrators 20 (which is a kind of pressure generating element according to the invention) forming the piezoelectric vibrator group 22 are formed in a vertically slender and longitudinal pectinate shape and are separated with an extremely narrow width of about several tens of μm. The piezoelectric vibrators 20 are formed as vertical vibration type piezoelectric vibrators which can be expanded and contracted vertically. The fixing end portion of each piezoelectric vibrator 20 is joined onto the fixing plate 23 and the free end portion thereof protrudes outside more than the front end of the peripheral edge of the fixing plate 23, so that each piezoelectric vibrator 20 is fixed in a cantilever form. The front end of the free end portion of each piezoelectric vibrator 20 is joined to an island portion 40 forming a diaphragm 38 in the passage unit 27, as described below. The flexible cable 24 is electrically connected to the piezoelectric vibrators 20 on a side surface of the fixing end portion opposite to the fixing plate 23. The fixing plate 23 holding the piezoelectric vibrators 20 is formed of a metal plate having rigidity capable of receiving a reactive force from the piezoelectric vibrators 20.

Next, the passage unit 27 will be described. The passage unit 27 which includes a nozzle plate 29, a passage forming board 30, and a vibration plate 31 is integrated by adhesion such that the nozzle plate 29 is attached and laminated onto one surface of the passage forming board 30 and the vibration plate 31 is attached and laminated onto the other surface of the passage forming board 30, which is opposite to the nozzle plate 29. The nozzle plate 29 is a stainless steel thin plate in which a plurality of nozzle openings 32 is formed in rows at a pitch corresponding to a dot formation density. In this embodiment, for example, 180 nozzle openings 32 are formed in rows. The nozzle openings 32 form a nozzle row (nozzle group). Two nozzle rows are formed in parallel. Moreover, the nozzle openings 32 according to this embodiment includes: a straight portion 42 disposed on an opposite side (ejection surface side) of the pressure generating chamber 35 in the nozzle plate 29 joined to the passage forming board 30; and a radially expanded portion 43 formed by expanding the radius from the straight portion 42 to the pressure generating chamber 35.

The passage forming board 30 is a plate-shaped member which forms a series of ink passages (which are kinds of liquid passages) made by a reservoir 33, an ink supply port 34, and the pressure generating chamber 35. Specifically, the passage forming board 30 is a plate-shaped member in which a plurality of empty portions serving as the pressure generating chamber 35 are divided by partition walls so as to correspond to the nozzle openings 32, respectively, and empty portions serving as the ink supply port 34 and the reservoir 33 are formed. The passage forming board 30 according to this embodiment is formed by etching a silicon wafer. The pressure generating chamber 35 is formed as a slender chamber formed in a direction perpendicular to a direction (nozzle row direction) in which the nozzle openings 32 line up. The ink supply port 34 is formed as a narrow portion of a passage communicating between the pressure generating chamber 35 and the reservoir 33. The reservoir 33 is a chamber which supplies the ink stored in an ink cartridge (not shown) to each pressure generating chamber 35 and which communicates with each pressure generating chamber 35 through the ink supply port 34.

The vibration plate 31 is a complex plate with a double structure formed by laminating a resin film 37 such as PPS (polyphenylene sulfide) on a holding plate 36 made of stainless steel metal. The vibration plate 31 is a member which includes the diaphragm 38 used by sealing one opening surface of the pressure generating chamber 35 to vary the volume of the pressure generating chamber 25 and a compliance 39 sealing one opening surface of the reservoir 33. The diaphragm 38 is formed by etching the holding plate 36 of a portion corresponding to the pressure generating chamber 35, removing the corresponding portion in a circular shape, and forming the island portion 40 joining the front end of the free end portion of the piezoelectric vibrators 20. The island portion 40 has a slender and longitudinal block shape in a direction perpendicular to a direction in which the nozzle openings 32 line up, like the planar shape of the pressure generating chamber 35. The resin film 37 near the island portion 40 serves as an elastic film. In a portion serving as the compliance 39, that is, in a portion corresponding to the reservoir 33, only the resin film 37 remains by removing the holding plate 36 in a shape similar to the opening shape of the reservoir 33 by etching.

In the printing head 10 having the above-described configuration, a variation in the pressure of the ink in the pressure generating chamber 35 is caused by the contraction or expansion of the corresponding pressure generating chamber 35 by deforming the pressure vibrators 20. By controlling the pressure of the ink, it is possible to eject ink (ink droplets) from the nozzle openings 32. When the pressure generating chamber 35 of the normal volume is expanded preliminarily before the ink ejection, the ink is supplied from the reservoir 33 to the pressure generating chamber 35 through the ink supply port 34. When the pressure generating chamber 35 is rapidly contracted after the preliminary expansion, the ink is ejected from the nozzle openings 32.

Figure 3:
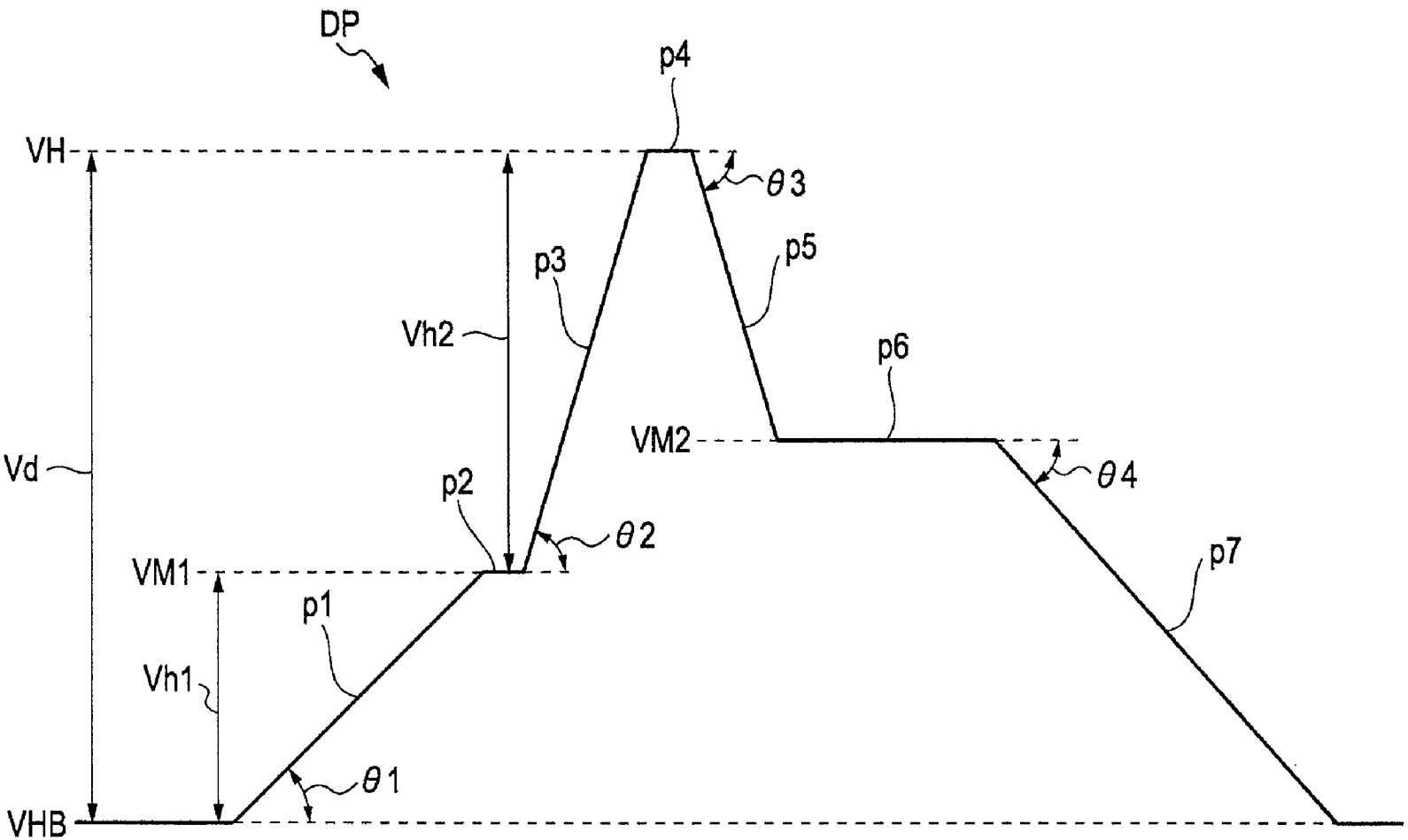
FIG. 3 is an explanatory diagram illustrating a waveform of an ejection pulse.

FIG. 3 is an explanatory diagram illustrating the structure of a waveform of an ejection pulse DP contained in the driving signal COM generated by the driving signal generating circuit 8 having the above-described configuration. The exemplary ejection pulse DP is an ejection pulse used to eject the smallest ink droplets among ink droplets ejected in the printer according to this embodiment. The ejection pulse DP includes: a first expansion component p1 (corresponding to an expansion component according to the invention) increasing potential from a reference potential VHB to a first mid potential VM1 at a constant slope (voltage variation ratio) θ1; a first hold component p2 (corresponding to an expansion hold component according to the invention) holding the first mid potential VM1, which is the rear end of the first expansion component p1, for a short period of time; a second expansion component p3 (corresponding to an expansion component according to the invention) increasing potential from the first mid potential VM1 to the maximum potential VH at a relatively sharp slope θ2 (where θ2>θ1); a second hold component p4 holding the maximum potential VH for a short period of time; a first contraction component p5 (corresponding to a first ejection component according to the invention) decreasing potential from the maximum potential VH to a second mid potential VM2 at a relatively sharp slope θ3; a third hold component p6 (corresponding to an ejection hold component according to the invention) holding the second mid potential VM2 for a certain period of time; and a second contraction component p7 (corresponding to a second ejection component according to the invention) decreasing potential from the second mid potential VM2 to the reference potential VHB at a constant slope θ4 (where θ4<θ3).

Figure 4A:
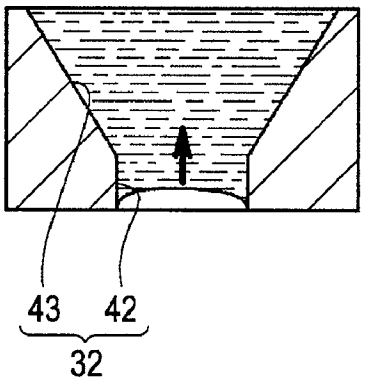
FIGS. 4A to 4F are diagrams illustrating the movement of a meniscus when an ink droplet is ejected.
Figure 4B:
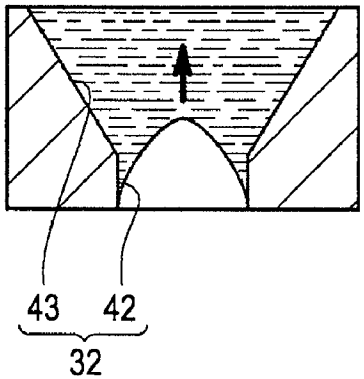

When the ejection pulse DP is supplied to the piezoelectric vibrators 20, the following operation is executed. First, when the first expansion component p1 is supplied to the piezoelectric vibrators 20, the corresponding vibrators 20 are contracted in a longitudinal direction of an element. Then, the pressure generating chamber 35 is expanded from a reference volume corresponding to the reference potential VHB to a volume corresponding to the first mid potential VM1 (first expansion step). In the first expansion step, the contraction of the pressure generating chamber 35 is executed more smoothly than the expansion of the pressure generating chamber 35 in the subsequent second expansion step. In this way, as shown in FIG. 4A, a meniscus in the straight portion 42 of the nozzle opening 32 starts to be gradually drawn toward the pressure generating chamber 35. In addition, as shown in FIG. 4B, the central portion of the meniscus is particularly drawn toward the pressure generating chamber 35 earlier than the peripheral edge of the meniscus with respect to the straight portion 42 in the nozzle opening 32, and thus the front end on the side of the pressure generating chamber 35 is infiltrated into the radially expanded portion 43. This is because the central portion of the meniscus moves more easily than the peripheral edge (which is closer to the inner circumference of the nozzle opening 32) of the meniscus and moves easily in response to the variation in the pressure. Accordingly, in order to solve delay of the movement in this embodiment, the slope θ1 from the reference potential VHB to the first mid potential VM1 is set to be smaller (gentler) than the slope θ2 from the first mid potential VM1 to the maximum potential VH. In this way, the expansion of the pressure generating chamber 35 in the first expansion step can prevent the ink in the outer peripheral edge of the meniscus in the straight portion 42 of the nozzle opening 32 from moving later than the ink in the central portion of the meniscus.

Subsequently, the expanded state of the pressure generating chamber 35 in the first expansion step is held constant during the supply period of the first hold component p2 (expansion hold step). In this way, the expansion of the pressure generating chamber 35 in the first expansion step can further prevent the ink in the outer peripheral edge of the meniscus from moving later than the ink in the central portion of the meniscus in the straight portion 42 of the nozzle opening 32. Meanwhile, the outer peripheral edge of the meniscus in the straight portion 42 of the nozzle opening 32 is gradually infiltrated into the radially expanded portion 43 after the infiltration of the central portion of the meniscus.

Figure 4C:
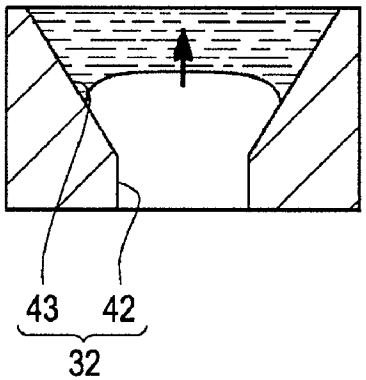

When the second expansion component p3 is supplied to the piezoelectric vibrators 20 after the supply of the first hold component p2, the corresponding piezoelectric vibrators 20 are further contracted more sharply in the longitudinal direction of the element than in the first expansion step. In this way, the pressure generating chamber 35 is rapidly expanded from the volume corresponding to the first mid potential VM1 to the volume corresponding to the maximum potential VH (second expansion step). In this way, as shown in FIG. 4C, the outer peripheral edge of the meniscus infiltrated into the radially expanded portion 43 from the straight portion 42 in the nozzle opening 32 is rapidly infiltrated into the radially expanded portion 43 along the inner circumferential surface of the radially expanded portion 43 formed by expanding the radius in a direction of drawing the ink, and thus the central portion and the outer peripheral edge of the meniscus can be further drawn toward the pressure generating chamber 35. The expanded state of the pressure generating chamber 35 in the second expansion step is held constant during the supply period of the second hold component p4.

Figure 4D:
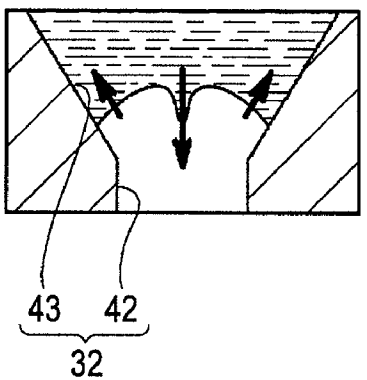

Subsequently, when the first contraction component p5 is supplied to the piezoelectric vibrators 20, the corresponding piezoelectric vibrators 20 are expanded, and thus the pressure generating chamber 35 is rapidly contracted from the volume corresponding to the maximum potential VH to the volume corresponding to the second mid potential VM2 (first ejection contraction step). The ink in the pressure generating chamber 35 is pressurized by the rapid contraction of the pressure generating chamber 35. In this way, as shown in FIG. 4D, the central portion of the meniscus in the radially expanded portion 43 in the nozzle opening 32 is swollen in a columnar shape. This is because the central portion of the meniscus is moved in a direction distant from the pressure generating chamber 35, but the outer peripheral edge of the meniscus is drawn toward the pressure generating chamber 35. That is, the central portion and the outer peripheral edge of the meniscus become an opposite phase state.

Figure 4E:
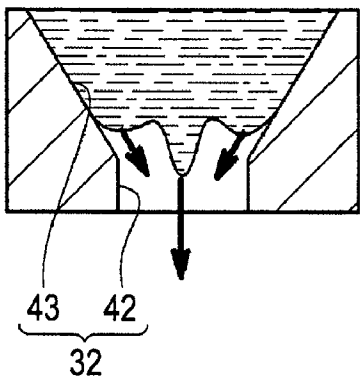

When the third hold component p6 is supplied to the piezoelectric vibrators 20, the second mid potential VM2 is held for a certain period of time (ejection contraction hold step). The contracted state of the pressure generating chamber 35 is held constant during the supply period of the third hold component p6. Meanwhile, as shown in FIG. 4E, the central portion and the outer peripheral edge of the meniscus become the same phase state in the direction distant from the pressure generating chamber 35. Like the expansion step, the central portion particularly moves toward the straight portion 42 from the radially expanded portion 43 and the front end corresponding to the center of the columnar shape is infiltrated into the straight portion 42 earlier than the circumference.

Figure 4F:
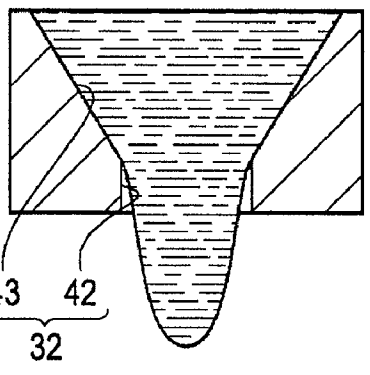

Subsequently, when the second contraction component p7 is supplied to the piezoelectric vibrators 20, the corresponding piezoelectric vibrators 20 are further expanded than in the first ejection contraction step, and then the pressure generating chamber 35 is contracted from the volume corresponding to the second mid potential VM2 to the volume corresponding to the reference potential VHB (second ejection contraction step). Here, the slope θ4 from the second mid potential VM2 to the reference potential VHB is set to be gentler than the slope θ3 from the maximum potential VH to the second mid potential VM2. In this way, the contraction of the pressure generating chamber 35 in the first contraction step can prevent the outer peripheral edge of the meniscus infiltrated into the straight portion 42 from moving later than the central portion of the meniscus. Meanwhile, as shown in FIG. 4F, the ink is discharged outside the nozzle opening 32 from the central portion of the meniscus, the columnar portion of the central portion of the meniscus is cut, and then the columnar portion is ejected as ink droplets of the number p1 corresponding to small dots from the nozzle opening 32.

In the above-described configuration, when ink (high-viscosity liquid) having a viscosity higher than that of known ink, such as photo curable ink cured by emitting a light energy such as ultraviolet rays, is ejected, it is possible to prevent the central portion of the meniscus and the outer peripheral edge of the meniscus in the nozzle opening from becoming the opposite phase, by supplying the piezoelectric vibrators 20 with the ejection pulse DP including the first expansion component p1, the second expansion component p2, the first contraction component p5, and the second contraction component p7 having the different variation ratios. Therefore, since the rear end of the ejected ink is prevented from growing into the tail-like portion, the ejected ink can be ejected in a shape almost close to a spherical shape. In this way, since the ink is prevented from being separated into plural pieces and landed on a landing target such as a print sheet, it is possible to reduce deterioration in the image quality on the print sheet. Moreover, since the first hold component p2 is included between the first expansion component p1 and the second expansion component p2 and the third hold component p6 is included between the first contraction component p5 and the second contraction component p7, it is possible to prevent the central portion of the meniscus and the outer peripheral edge of the meniscus from becoming the opposite phase. Therefore, it is possible to prevent the tail-like portion appended in the ejected liquid from growing. Moreover, it is possible to inhibit the deterioration in the flying speed of the ink due to the opposite phase.

In a known configuration having no solution, the tail-like portion of ink is easily drawn, when the middle dot is formed with the high viscosity ink. For this reason, the tail-like portion is separated from the main portion of a liquid droplet of the middle dot, and thus the separated portions (satellite ink droplets or mist) are landed on different locations of the print sheet, thereby resulting in deteriorating the image quality to a great extent. In order to solve this problem, the slope θ1 from the reference potential VHB to the first mid potential VM1 is set to be gentler than the slope θ2 from the first mid potential VM1 to the maximum potential VH. Moreover, the slope θ4 from the second mid potential VM2 to the reference potential VHB is set to be gentler than the slope θ3 from the maximum potential VH to the second mid potential VM2. Accordingly, it is possible to prevent the outer peripheral edge of the meniscus infiltrated into the straight portion 42 from moving later than the central portion of the meniscus.

The invention is not limited to the above-described embodiment, but may be modified in various forms within the scope of the claims.

Figure 5:
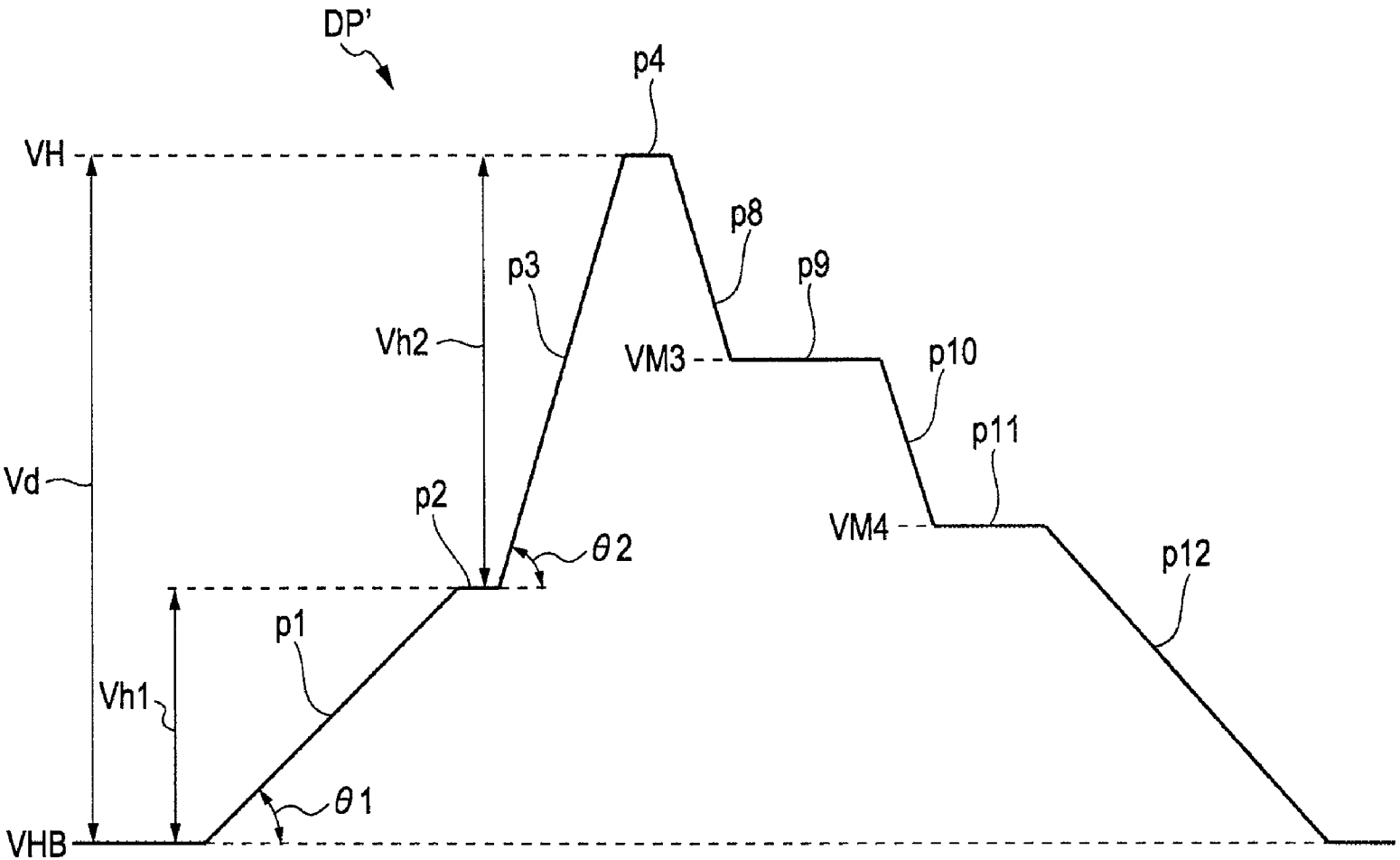
FIG. 5 is an explanatory diagram illustrating a waveform of an ejection pulse according to a modified example.

FIG. 5 is an explanatory diagram illustrating a waveform of an ejection pulse according to a modified example. In the above-described embodiment, the ejection pulse according to the invention includes two contraction components, that is, the first contraction component p5 and the second contraction component p7. However, the shape of the ejection pulse is not limited thereto. For example, an ejection pulse DP' shown in FIG. 5 may include: a third contraction component p8 (corresponding to an ejection component according to the invention) decreasing potential from the maximum potential VH to a third mid potential VM3 at a constant slope; a fourth hold component p9 (corresponding to an ejection hold component according to the invention) holding the third mid potential VM3 for a certain period of time; a fourth contraction component p10 (corresponding to an ejection component according to the invention) decreasing potential from the third mid potential VM3 to a fourth mid potential VM4 at a constant slope; a fifth hold component p11 (corresponding to an ejection hold component according to the invention) holding the fourth mid potential VM4 for a certain period of time; and a second contraction component p12 (corresponding to an ejection component according to the invention) decreasing potential from the fourth mid potential VM4 to the reference potential VHB at a constant slope. That is, the ejection pulse DP' may include three contraction components.

Accordingly, when the high viscosity ink is ejected by the contraction of the pressure generating chamber 35, it is possible to further prevent the central portion of the meniscus and the outer peripheral edge of the meniscus from becoming the opposite phase. Therefore, it is possible to prevent the tail-like portion appended in the ejected ink from growing. Moreover, it is possible to inhibit the deterioration in the flying speed of the ink due to the opposite phase. That is, the ejection pulse DP may use an arbitrary waveform, as long as the ejection pulse DP includes the first expansion component p1 and the second expansion component p2 having the variation ratio different from that of the first expansion component p1.

In the above-described embodiment, the piezoelectric vibrators 20 of a so-called vertical vibration mode is exemplified as the pressure generating unit, but the invention is not limited thereto. For example, the invention is applicable to a case where a piezoelectric vibrator of a so-called flexible vibration mode is used. Moreover, even when the piezoelectric vibrator of the flexible vibration mode is used, the waveform of the ejection pulse DP shown in FIG. 3 is reversed vertically.

The invention is not limited to the printer, as long as there is provided a liquid ejecting apparatus capable of controlling ejection by use of a plurality of driving signals. That is, the invention is applicable to a variety of ink jet printing apparatuses such as a plotter, a facsimile apparatus, and a copy apparatus. Moreover, the invention is applicable to a liquid ejecting apparatus, such as a display manufacturing apparatus, an electrode manufacturing apparatus, and a chip manufacturing apparatus, other than the printing apparatus.

What is claimed is:

1. A liquid ejecting apparatus comprising:

a liquid ejecting head which comprises a pressure generating chamber communicating with a nozzle opening and a pressure generating element configured to cause variation in a pressure of a liquid in the pressure generating chamber, wherein the liquid ejecting head is configured to eject the liquid from the nozzle opening by an operation of the pressure generating element; and a driving signal generating unit configured to generate a series of driving signals containing a driving pulse used to drive the pressure generating element, wherein the driving pulse generated by the driving signal generating unit contains a plurality of expansion components for expanding the pressure generating chamber and drawing a meniscus and an ejection component for contracting the expanded pressure generating chamber and ejecting a liquid droplet, and wherein the expansion component comprises a first expansion component drawing the meniscus at a first rate of change of voltage and a second expansion component drawing the meniscus at a second, different rate of change of voltage.

2. The liquid ejecting apparatus according to claim 1, wherein the first rate of change of voltage is smaller than the second rate of change of voltage.

3. The liquid ejecting apparatus according to claim 1, wherein the driving pulse further contains an expansion hold component, which maintains a voltage of an end of the first expansion component for a certain period of time, provided between the first and second expansion components.

4. The liquid ejecting apparatus according to claim 1, wherein the ejection component comprises a first ejection component contracting the pressure generating chamber at a third rate of change of voltage and a second ejection component contracting the pressure generating chamber at a fourth, different rate of change of voltage.

5. The liquid ejecting apparatus according to claim 4, wherein the driving pulse further contains an ejection hold component, which maintains a voltage of an end of the first ejection component for a certain period of time, provided between the first and second ejection components.

6. A method of controlling a liquid ejecting apparatus including a liquid ejecting head which comprises a pressure generating chamber communicating with a nozzle opening and a pressure generating element configured to cause variation in a pressure of a liquid in the pressure generating chamber, wherein the liquid ejecting head is configured to eject the liquid from the nozzle opening by an operation of the pressure generating element, and a driving signal generating unit configured to generate a series of driving signals containing a driving pulse used to drive the pressure generating element, the method comprising:

a plurality of expansion steps of expanding the pressure generating chamber and drawing a meniscus; and an ejection step of contracting the expanded pressure generating chamber and ejecting a liquid droplet, wherein the expansion steps comprise a first expansion step comprising drawing the meniscus at a first rate of change of voltage and a second expansion step comprising drawing the meniscus at a second, different rate of change of voltage.

* * * * *